US009956795B2

(12) United States Patent
Ogimura

(10) Patent No.: US 9,956,795 B2
(45) Date of Patent: May 1, 2018

(54) PRINTING APPARATUS

(71) Applicant: SEIKO EPSON CORPORATION, Tokyo (JP)

(72) Inventor: Takafumi Ogimura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/491,012

(22) Filed: Apr. 19, 2017

(65) Prior Publication Data

US 2017/0313104 A1 Nov. 2, 2017

(30) Foreign Application Priority Data

Apr. 27, 2016 (JP) ..... 2016-088882

(51) Int. Cl.
*B41J 13/00* (2006.01)
*B41J 11/04* (2006.01)

(52) U.S. Cl.
CPC ..... *B41J 13/0009* (2013.01); *B41J 11/04* (2013.01)

(58) Field of Classification Search
CPC ..... B41J 2/04536; B41J 2/04581
See application file for complete search history.

(56) References Cited

U.S. PATENT DOCUMENTS 6,085,064 A * 7/2000 Nagase ..... G03G 15/657 271/311
2013/0259555 A1* 10/2013 Haruyama ..... G03G 15/6576 399/406

FOREIGN PATENT DOCUMENTS

JP 2010-158844 A 7/2010

* cited by examiner

*Primary Examiner* — Lamson Nguyen

(57) ABSTRACT

A printing apparatus includes a print unit; a first roller that transport the medium; a plurality of second rollers cooperating with the first roller to nip the medium therebetween at positions that face the first rollers; a third roller that holds the medium which has been transported by the first roller and transport the medium to a print path in which printing is performed by the print unit; a specific second roller located most downstream in the transportation path among the second rollers; and a control unit that controls each of the roller and the print unit, wherein the control unit causes the specific second roller to be displaced to a separated position after the medium is held by the third roller.

5 Claims, 5 Drawing Sheets

PRINTING APPARATUS

CROSS REFERENCES TO RELATED APPLICATIONS

The entire disclosure of Japanese Patent Application No. 2016-088882, filed Apr. 27, 2016 is expressly incorporated by reference herein.

BACKGROUND

1. Technical Field

The present disclosure relates to a printing apparatus.

2. Related Art

The printing apparatus transports a medium, which is set on a medium supply source such as a cassette or tray, by means of rotation of a plurality of rollers, and performs printing on the medium of a transportation target.

Further, JP-A-2010-158844 discloses a printer which includes an abutment member having a tangent vector to the outer circumference of a transportation roller obliquely upward relative to a support surface of a platen, and a pinch roller having a tangent vector to the outer circumference of the transportation roller obliquely downward relative to the support surface of the platen, and controls rotation of the transportation roller and abutment of the pinch roller so that a sheet is transported while being nipped between the transportation roller and the abut member in the state in which the pinch roller is separated, and then the leading edge of the sheet is fed to reach the support surface of the platen by switching the pinch roller from a separated position to an abutment position.

In order to improve print quality, it has been required to stabilize a position of the medium which undergoes a printing process to the transportation direction. Further, in order to improve print efficiency, it is useful to narrow a distance between a medium and another medium (inter-medium distance) during transportation. In the field of conventional art, improvement is still needed regarding the position of medium and decrease in inter-medium distance.

SUMMARY

An advantage of some aspects of the disclosure is that a printing apparatus useful for solving at least one of the above problems is provided.

According to one aspect of the present disclosure, a printing apparatus includes: a print unit that performs printing onto a medium; a first roller that transports the medium along a predetermined transportation path; a plurality of second rollers that abut against the medium at a plurality of positions that face the first rollers; a third roller disposed downstream relative to the first roller and the second roller in the transportation path so as to hold the medium which has been transported by the first roller and transport the medium to a print path in which printing is performed by the print unit; a specific second roller which is a roller located most downstream in the transportation path among the second rollers, the specific second roller being displaced between a first position in which the specific second roller abuts against the medium and a second position in which the specific second roller cannot abut against the medium; and a control unit that controls each of the roller and driving of the print unit, wherein the control unit causes the specific second roller to be displaced from the first position to the second position after the medium is held by the third roller.

According to the above configuration, the specific second roller is separated from the medium after the medium is held by the third roller. As a result, a force applied from the specific second roller to the medium is released, thereby facilitating the stabilization of the position of the medium.

According to one aspect of the present disclosure, the printing apparatus may include: a first drive source that rotates the first roller; and a second drive source that rotates the third roller, wherein the first roller includes a supply roller that supplies the medium from the supply source of the medium to the transportation path, and a transportation roller that transports the medium supplied by the supply roller to a downstream region in the transportation path, and the control unit causes the supply roller to be rotated by the first drive source to thereby supply a subsequent medium from the supply source to the transportation path when a trailing edge of the medium passes by the roller which is located most downstream in the transportation path among the second rollers except for the specific second roller after the specific second roller is displaced to the second position.

According to the above configuration, the subsequent medium is supplied from the supply source at the timing when the trailing edge of the preceding medium passes by the roller located most downstream in the transportation path among the second rollers except for the specific second roller. Therefore, an inter-medium distance can be reduced.

According to one aspect of the present disclosure, when the trailing edge of the medium passes by a position of the specific second roller, the control unit may allow only the transportation roller to be rotated by the first drive source and causes the specific second roller to be displaced from the second position to the first position.

According to the above configuration, after the trailing edge of the preceding medium passes by the position of the specific second roller, only the transportation roller is allowed to be rotated by the first drive source (of the supply roller and the transportation roller, rotation of the supply roller is stopped) and the specific second roller is returned to the first position. Accordingly, the subsequent medium can be appropriately transported by rotation of the transportation roller and the plurality of second roller including the specific second roller.

According to one aspect of the present disclosure, the control unit may cause the specific second roller to be displaced from the second position to the first position when the leading edge of the subsequent medium reaches a specific position which is a position between the specific second roller and the roller which is located most downstream in the transportation path among the second rollers except for the specific second roller, and the position being close to the specific second roller, after the trailing edge of the medium passes by the position of the specific second roller.

According to the above configuration, power consumption can be reduced by delaying a timing at which the specific second roller is returned from the second position to the first position as much as possible.

According to one aspect of the present disclosure, if printing by the print unit to the medium held by the third roller is printing for the last page, the control unit may stop the first drive source when the trailing edge of the medium to which the printing for the last page is performed passes by the roller which is located most downstream in the transportation path among the second rollers except for the specific second roller.

According to the above configuration, power consumption can be reduced since the first drive source is immediately stopped when the first roller does not need to rotate for the medium transportation.

The technical idea of the present disclosure can be implemented by various ways in addition to a product which is the printing apparatus. For example, a method including the steps performed by components of the printing apparatus (medium transportation method) can be regarded as the disclosure. Furthermore, a program for a computer executing such a method, and a computer readable storage medium that stores the program are also regarded as the disclosure.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

Figure 1:
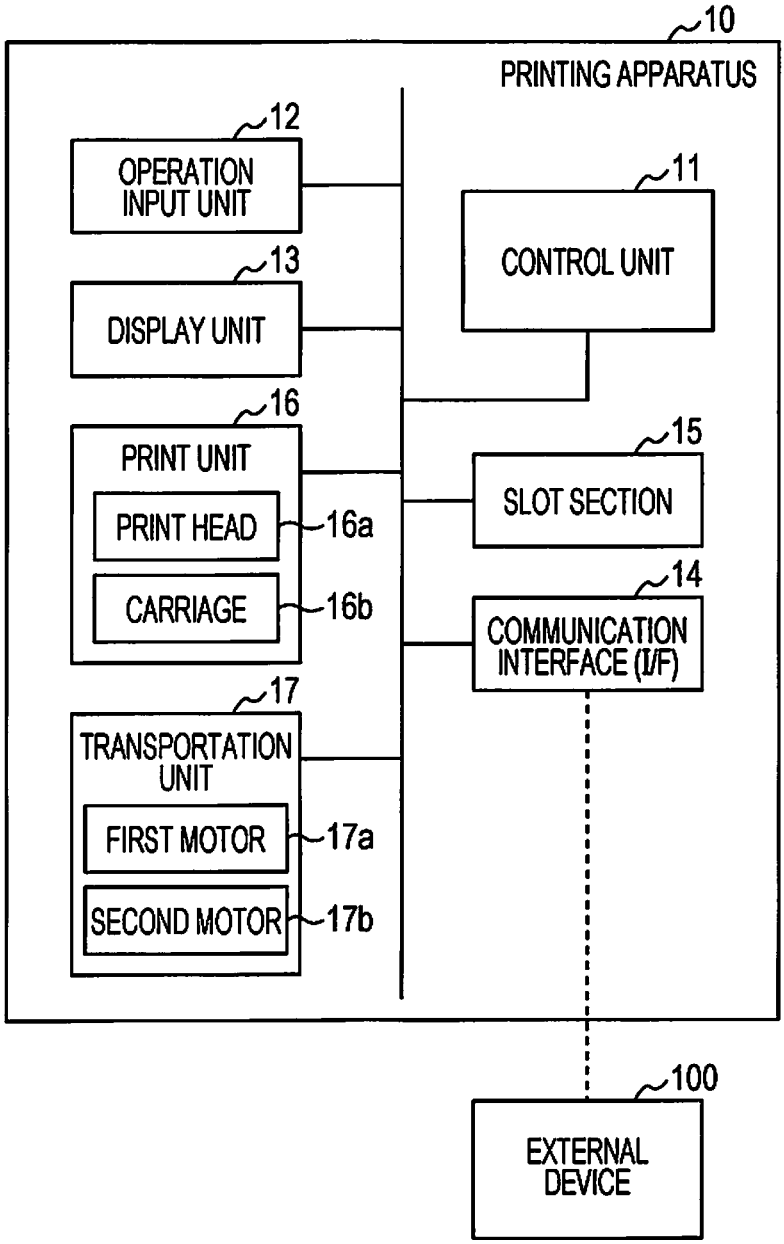
FIG. 1 is a block diagram which shows a configuration of a printing apparatus.

With reference to the drawings, an embodiment of the present disclosure will be described. The drawings are merely examples for explaining the present embodiment. Further, shapes and dimensions shown in the drawings may not be to scale.

FIG. 1 is a block diagram which illustrates a configuration of a printing apparatus 10 according to the present embodiment. The printing apparatus 10 can perform printing on a medium on the basis of the print data which represents an image (image which may include various objects such as pictures, CG, and characters). The printing apparatus 10 is considered to be a product such as a printer or a multifunction machine having a plurality of functions, for example, printer, scanner, or facsimile. The printing apparatus may be referred to as a recording apparatus, liquid ejection apparatus, or the like. Further, part or the entire of printing apparatus may be referred to as a print controller or the like. In FIG. 1, the printing apparatus 10 is illustrated as a configuration that includes a control unit 11, an operation input unit 12, a display unit 13, a communication interface (I/F) 14, a slot section 15, a print unit 16, a transportation unit 17 and the like.

The control unit 11 is made up of, for example, an IC which includes CPU, ROM, RAM and the like, other storage medium, and electronic circuit. In the control unit 11, for example, the CPU executes arithmetic processing according to a program stored in the ROM or the like by using the RAM or the like as a work area to thereby control driving of the configurations of the printing apparatus 10.

The operation input unit 12 includes various buttons and keys for receiving operations from a user. The display unit 13 is a portion for displaying various information on the printing apparatus 10, and is formed of, for example, a liquid crystal display (LCD). Part of the operation input unit 12 may be implemented as a touch panel displayed on the display unit 13.

The print unit 16 is a mechanism for printing an image on the basis of the print data on the medium under control of the control unit 11. The medium is typically a paper sheet, but may be a material other than a paper sheet, for example, a film or sheet made of resin, composite film of resin and metal (laminated film), fabric, non-woven cloth, metal foil, metal film, ceramic sheet or the like. When the print unit 16 adopts an ink jet printing method, the print unit 16 includes a print head 16*a* which has a plurality of nozzles and is configured to eject liquid (ink) from the nozzles, a carriage 16*b* on which the print head 16*a* is mounted and which is configured to move in a predetermined main scan direction, a carriage motor (not shown in the figure) which serves as a power source for movement of the carriage 16*b*, and the like. The print head may also be referred to as a print head, recording head, liquid ejection head or the like. Although not shown in the figure, the print head 16*a* receives the supply of ink from an ink cartridge or the like that stores ink, and ejects the supplied ink from the nozzles. As the ink ejected from the respective nozzles is attached on the medium, ink dots are formed on the medium.

The transportation unit 17 performs transportation of the medium under control by the control unit 11. The transportation unit 17 includes rollers (for example, rollers 20, 21, 22, 23, 24, and 25 shown in FIGS. 2A to 2C and the like) that rotate so as to transport the medium along a predetermined transportation path, a first motor 17*a* and a second motor 17*b* which serve as a power source that rotates the rollers, and a gear train (not shown in the figure) that transmits a power generated by the motors 17*a* and 17*b* to the rollers and the like. The print head 16*a* performs printing by ejecting ink onto the medium transported by the transportation unit 17 along the transportation path. The types and numbers of ink ejected by the print head 16*a* is not specifically limited. The first motor 17*a* is an example of the first drive source, the second motor 17*b* is an example of the second drive source. The control unit 11 individually drives the motors 17*a* and 17*b*. The control unit 11 may be considered as a configuration which includes a plurality of motor driver circuits that individually drives the motors 17*a* and 17*b*.

The communication I/F 14 is a general term of the interfaces that allows for connection between the printing apparatus 10 and an external device 100 via a wired or wireless network. The external device 100 may be various devices through which information necessary for printing by the printing apparatus 10 (for example, print job data including the print data) is entered, which may be smart phones, tablet terminals, digital still cameras, personal computers (PC) and the like. The printing apparatus 10 can be connected to the external device 100 via the communication I/F 14, for example, via various means or communication standards such as USB cable, wired network, wireless LAN, E-mail and the like. The slot section 15 is a portion for inserting an external storage medium such as a memory card. In other words, information necessary for printing can also be entered to the printing apparatus 10 through the external storage medium such as a memory card inserted in the slot section 15.

FIGS. 2A to 2C and FIGS. 3A and 3B are simplified views which show a configuration in the printing apparatus 10 mainly for transportation of a medium P viewed in the main scan direction of the carriage 16*b*. In FIGS. 2A to 2C and FIGS. 3A and 3B, the main scan direction is a direction perpendicular to the sheet of each drawing. Further, in FIGS.

Figure 2A:
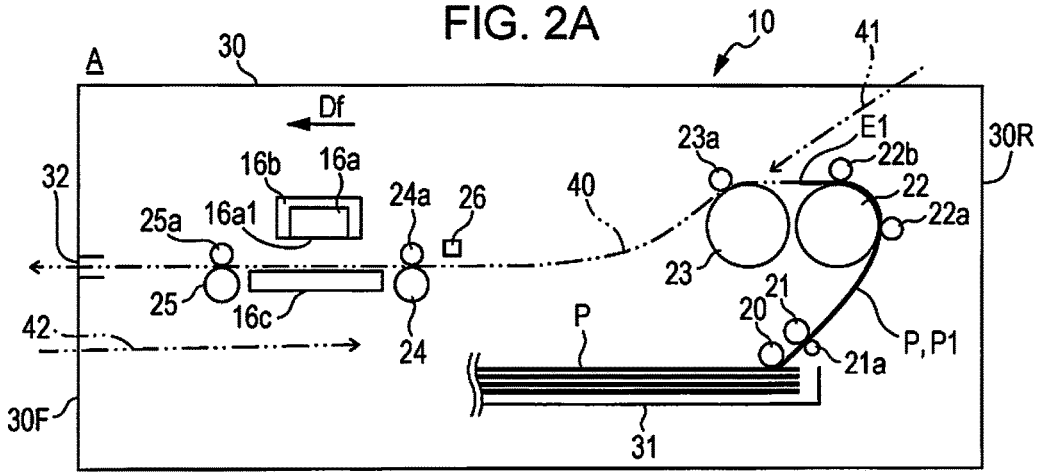
FIGS. 2A to 2C are simplified views which show positional change of a medium transported according to the present embodiment.
Figure 2B:
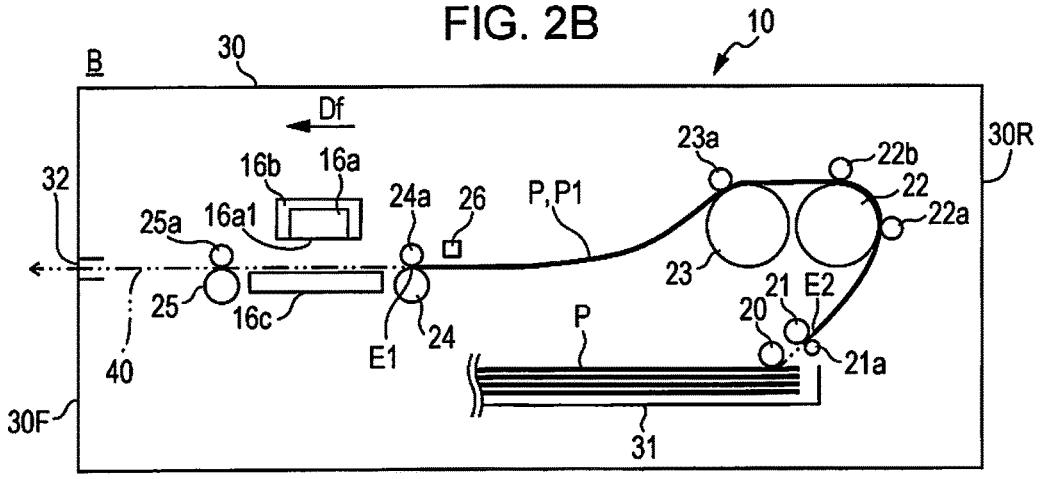
Figure 2C:
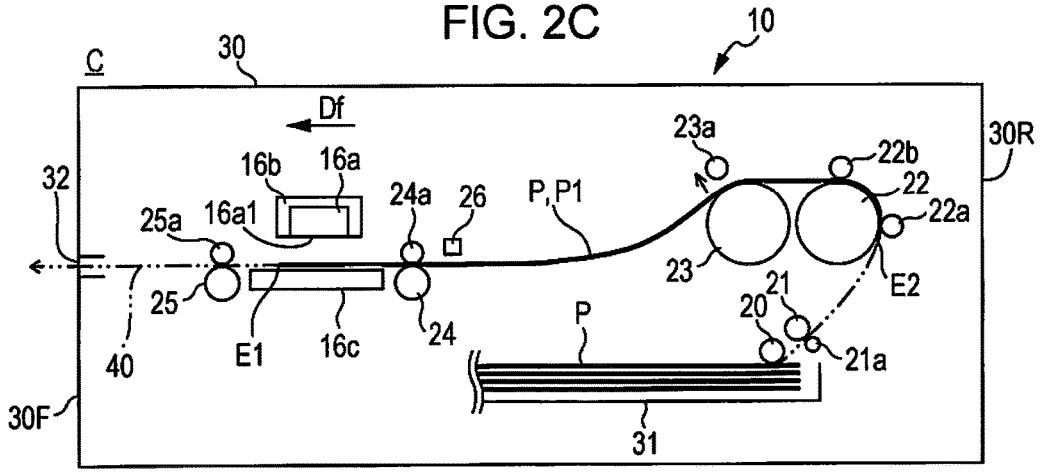
Figure 3A:
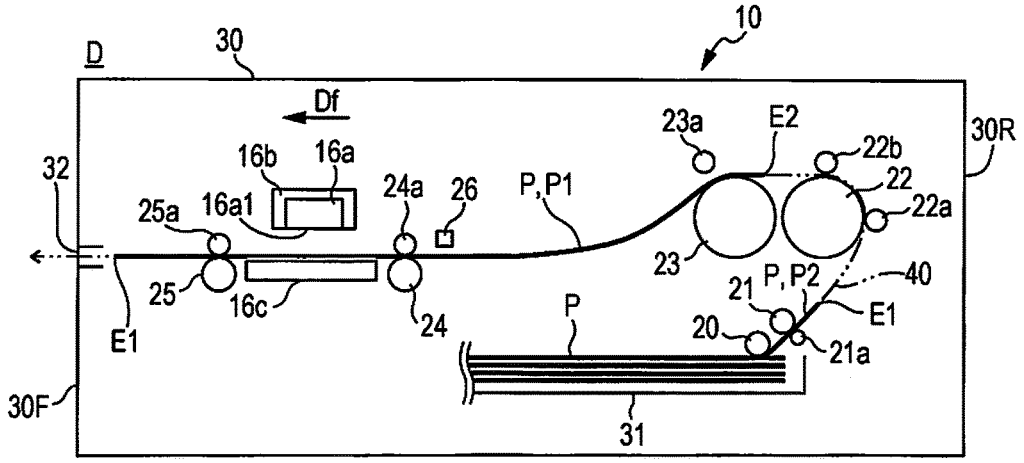
FIGS. 3A and 3B are simplified views which show positional change of a medium transported according to the present embodiment.
Figure 3B:
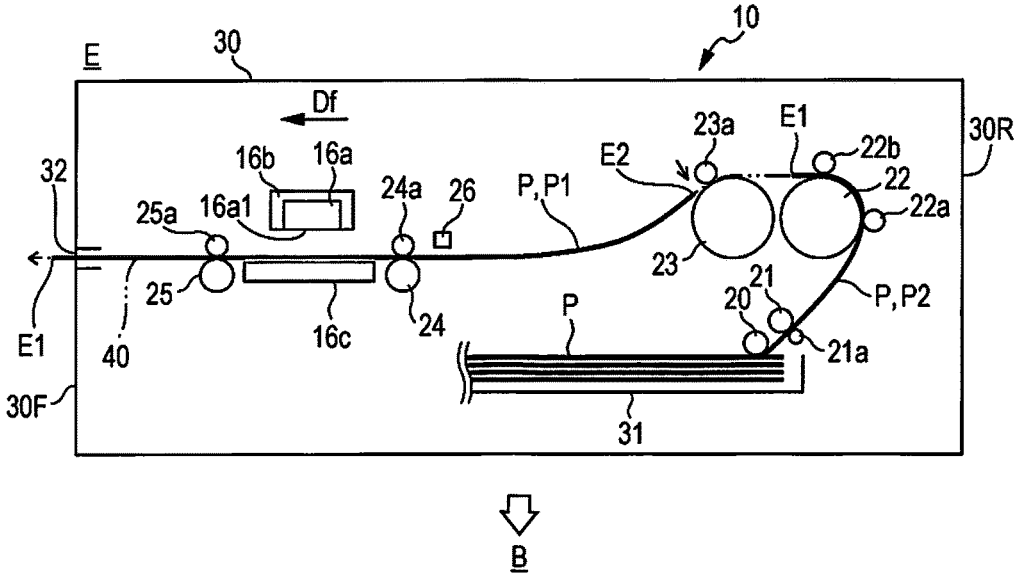

2A to 2C and FIGS. 3A and 3B, positional change of the medium P transported by the transportation unit 17 is shown step-by-step by illustrating a state A (FIG. 2A), state B (FIG. 2B), state C (FIG. 2C), state D (FIG. 3A) and state E (FIG. 3B). Reference character Df indicates a transport direction of the medium P transported during printing by the print unit 16 (print head 16*a*). The transport direction Df is basically perpendicular to the main scan direction.

The printing apparatus 10 includes, for example, a cassette 31 that can house a plurality of media P, and an output port 32 that outputs the medium P to the outside of the housing 30 of the printing apparatus 10. In the example shown in FIGS. 2A to 2C and FIGS. 3A and 3B, the cassette 31 is housed in a lower part of the housing 30. The cassette 31 is a type of a supply source of the medium P. Of course, a user can attach the cassette 31 to the housing 30 or withdraw the cassette 31 from the housing 30. Although only one cassette 31 is shown in FIGS. 2A to 2C and FIGS. 3A and 3B, the printing apparatus 10 may include a plurality of cassettes 31 as a supply source of the medium P. The output port 32 is disposed, for example, on the front surface 30F of the housing 30. The front surface 30F is a surface that usually faces a user. For example, the operation input unit 12 and the display unit 13 are disposed at positions close to the front surface 30F. Further, a surface of the housing 30 opposite from the front surface 30F is referred to as a rear surface 30R.

The printing apparatus 10 includes a transportation path 40 of the medium P indicated by the alternate long and two short dash line arrow in FIGS. 2A to 2C and FIGS. 3A and 3B from a supply source of the cassette 31 to the output port 32. The cassette 31 is the most upstream region in the transportation path 40. The output port 32 is the most downstream region in the transportation path 40. Hereinafter, the term "upstream" refers to a region upstream in the transportation path, and the term "downstream" refers to a region downstream in the transportation path. Further, the edge of the medium P oriented downstream is referred to as a leading edge (or front edge) E1, and the edge of the medium P oriented upstream is referred to as a trailing edge E2.

A pickup (PU) roller 20 and a separation roller 21 are disposed in vicinity to the cassette 31. The PU roller 20 rotates while being in contact with the uppermost medium P housed in the cassette 31 to thereby feed the medium P from the cassette 31 to the transportation path 40. The medium P fed by the PU roller 20 is separated into single sheets when passing between the separation roller 21 and a driven roller 21*a* that faces the separation roller 21, and is supplied downstream from the separation roller 21 as a single sheet.

Intermediate rollers 22 and 23 are disposed downstream from the separation roller 21 in the transportation path 40. Further, a plurality of driven rollers 22*a*, 22*b*, and 23*a* are disposed in vicinity to the intermediate rollers 22 and 23 so as to correspond to the intermediate rollers 22 and 23 along the transportation path 40. The medium P supplied from the cassette 31 is nipped between the intermediate roller 22 and the driven roller 22*a*, and then, nipped between the intermediate roller 22 and the driven roller 22*b*, and further, nipped between the intermediate roller 23 and the driven roller 23*a* to be transported downstream while the intermediate rollers 22 and 23 rotate. Note that the intermediate roller may not be necessarily two rollers 22 and 23 shown in the figure, but may also be one roller or three or more rollers. Further, the driven roller which faces the intermediate roller may not be necessarily three driven rollers 22*a*, 22*b*, and 23*a* shown in the figure, but may also be two driven rollers or four or more driven rollers.

The rollers 20, 21, 22, and 23 correspond to a first roller that transports the medium P along a predetermined transportation path (transportation path 40). The first roller (rollers 20, 21, 22, and 23) rotates by the first motor 17*a*. Further, the first roller can be divided into a supply roller that supplies the medium P from the supply source of the medium P to the transportation path, and a transportation roller that transports the medium P supplied from the supply roller to the downstream region in the transportation path. As an example, the PU roller 20 and the separation roller 21 correspond to the supply roller, while the intermediate rollers 22 and 23 correspond to the transportation roller. The driven rollers 21*a*, 22*a*, 22*b*, and 23*a* correspond to a plurality of second rollers that abut the medium P at a plurality of positions which face the first rollers.

In the present embodiment, the control unit 11 can control the first motor 17*a* to rotate the first rollers (rollers 20, 21, 22, and 23) in a first drive mode or in a second drive mode. Specifically, the first drive mode is a mode by which all the first rollers, that is, both the supply rollers (PU roller 20 and the separation roller 21) and the transportation rollers (intermediate rollers 22 and 23) rotate. On the other hand, the second drive mode is a mode by which, among the first rollers, the supply rollers (PU roller 20 and separation roller 21) do not rotate and the transportation rollers (intermediate rollers 22 and 23) rotate.

The relationship between rotation of the first motor 17*a* and rotation of the rollers 20, 21, 22, and 23 will be described. The motor can rotate in both a forward rotation direction (CW) and a reverse rotation direction (CCW). In the present embodiment, the gear train between the first motor 17*a* and the rollers 20, 21, 22, and 23 are arranged so that all the rollers 20, 21, 22, and 23 rotate to transport the medium P to the downstream region when the first motor 17*a* rotates in a first direction (for example, forward rotation direction). Further, the gear train between the first motor 17*a* and the intermediate rollers 22 and 23 are arranged so that the intermediate rollers 22 and 23 rotate to transport the medium P to the downstream region when the first motor 17*a* rotates in a second direction (for example, reverse rotation direction). The rollers 20 and 21 can idle when not driven by the first motor 17*a*. With this configuration, the control unit 11 enables the first drive mode by rotating the first motor 17*a* in the first direction and the second drive mode by rotating the first motor 17*a* in the second direction.

Of the second rollers (driven rollers 21*a*, 22*a*, 22*b*, and 23*a*), the driven roller 23*a*, which is the most downstream roller, corresponds to a specific second roller. In the present embodiment, the driven roller 23*a* which corresponds to the specific second roller can be displaced between a first position that abuts the medium P and a second position that cannot abut the medium P. The first position is a position of the driven roller 23*a* when the driven roller 23*a* and the intermediate roller 23 nip the medium P therebetween, and the second position is a position of the driven roller 23*a* when the driven roller 23*a* is separated from the intermediate roller 23 so as not to nip the medium P. The displacement of the driven roller 23*a* is also controlled by the control unit 11. In addition, in the states A and B shown in FIGS. 2A and 2B, respectively, and the state E shown in FIG. 3B, the driven roller 23*a* is located at the first position. In the state C shown in FIG. 2C and the state D shown in FIG. 3A, the driven roller 23*a* is located at the second position.

A print transportation roller 24 and an output roller 25 are disposed downstream from the first rollers (rollers 20, 21, 22, and 23) and the second rollers (driven rollers 21*a*, 22*a*, 22*b*, and 23*a*) in the transportation path 40. A driven roller 24*a* is disposed at a position that faces the print transportation roller 24, and a driven roller 25*a* is disposed at a position that faces the output roller 25. The print transportation roller 24 corresponds to a third roller that nips (by cooperating with the driven roller 24*a*) the medium P which is transported by the first roller to a print path in which printing is performed by the print unit 16 (print head 16*a*).

A platen 16*c* forms part of the transportation path 40. The platen 16*c* corresponds to a print path. The print transportation roller 24 and the driven roller 24*a* are disposed upstream relative to the platen 16*c*, and the output roller 25 and the driven roller 25*a* are disposed downstream relative to the platen 16*c*. A medium detection sensor 26 that detects the medium P is disposed slightly upstream relative to the print transportation roller 24. A detection signal which represents detection result from the medium detection sensor 26 is transmitted to the control unit 11.

The print head 16*a* is disposed at a position above the platen 16*c* so as to face the platen 16*c*. The print head 16*a* moves in a main scan direction by the carriage 16*b* with a nozzle surface 16*a*1 on which nozzles are open being oriented to the platen 16*c*. The medium P transported along the transportation path 40 with the rotation of the first roller is then nipped between the intermediate roller 24 and the driven roller 24*a*, and subsequently, nipped between the output roller 25 and the driven roller 25*a* to be transported downstream while the rollers 24 and 25 rotate. The rollers 24 and 25 rotate by the second motor 17*b*.

The medium P is intermittently transported while it passes under a nozzle surface 16*a*1 (intermittent transportation). In other words, after the leading edge E1 of the medium P is nipped between the rollers 24 and 24*a*, intermittent transportation by the rotation of the rollers 24 and 25 and the ink ejection by the print head 16*a* (a pass of the print head 16*a*) associated with the movement of the carriage 16*b* in the main scan direction are alternately repeated to thereby perform printing on the surface of the medium P which faces the nozzle surface 16*a*1 on the platen 16*c*. After printing, the trailing edge E2 of the medium P is usually located downstream relative to the print transportation roller 24. At this time, the medium P is not nipped between the rollers 24 and 24*a* but is nipped between the roller 25 and 25*a*. From this state, the medium P is transported further downstream by rotation of the output roller 25, and is outputted from the output port 32.

Figure 4A:
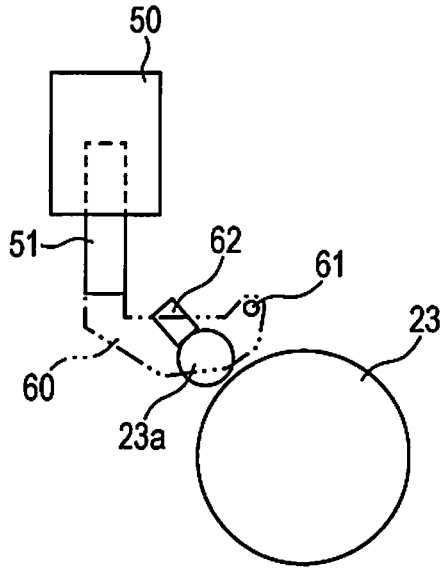
FIGS. 4A and 4B are views which illustrate a mechanism to displace a specific second roller.
Figure 4B:
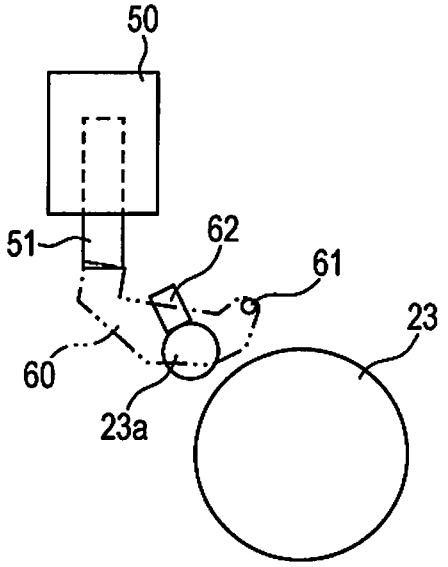

FIGS. 4A and 4B are views which illustrate a mechanism to displace the driven roller 23*a*. FIGS. 4A and 4B show only a partial configuration in the vicinity of the driven roller 23*a*. In the example of FIGS. 4A and 4B, a self-sustaining solenoid 50 is used as a drive source for displacing the driven roller 23*a*. The solenoid 50 includes a movable core 51, and is configured to displace the movable core 51 in an axial direction by applying an electric current to the coil in the solenoid 50 to generate a magnetic field.

The driven roller 23*a* is mounted on the driven roller unit 60. The driven roller unit 60 is provided with a shaft 61 which extends parallel to shafts of the rollers, and the shaft 61 penetrates through one end of the driven roller unit 60 so as to be rotatable about the shaft 61. Further, the other end of the driven roller unit 60 is connected to the movable core 51 so as to be directly or indirectly pivotable to the movable core 51. The control unit 11 can switch the direction of the electric current supplied to the solenoid 50 to thereby switch the states of the solenoid 50 between the state shown in FIG. 4A in which the movable core protrudes from the solenoid 50 by a longer length (protruded state) and the state shown in FIG. 4B in which the movable core protrudes from the solenoid 50 by a shorter length (housed state). The self-sustaining solenoid 50 includes a permanent magnet therein so that the state (protruded or housed state) can be maintained in case of suspension of external current supply.

In coordination with the displacement of the movable core 51, the driven roller 23*a* is displaced along with the driven roller unit 60. In other words, when the control unit 11 moves the solenoid 50 to the protruded state (see FIG. 4A), the driven roller 23*a* is held at a position close to the intermediate roller 23 (first position). On the other hand, when the control unit 11 moves the solenoid 50 to the housed state, the driven roller 23*a* is held at a position away from the intermediate roller 23 (second position) (see FIG. 4B). The driven roller unit 60 includes a bias member 62 formed by a spring or the like. The bias member 62 biases the driven roller 23*a* toward the intermediate roller 23. Accordingly, when located at the first position, the driven roller 23*a* can cooperate with the intermediate roller 23 to reliably hold the medium P therebetween by force exerted from the bias member 62.

Further, the mechanism to displace the driven roller 23*a* is not limited to a mechanism which uses the solenoid 50, and may be any mechanism as long as it can eventually displace the driven roller 23*a*.

Figure 5A:
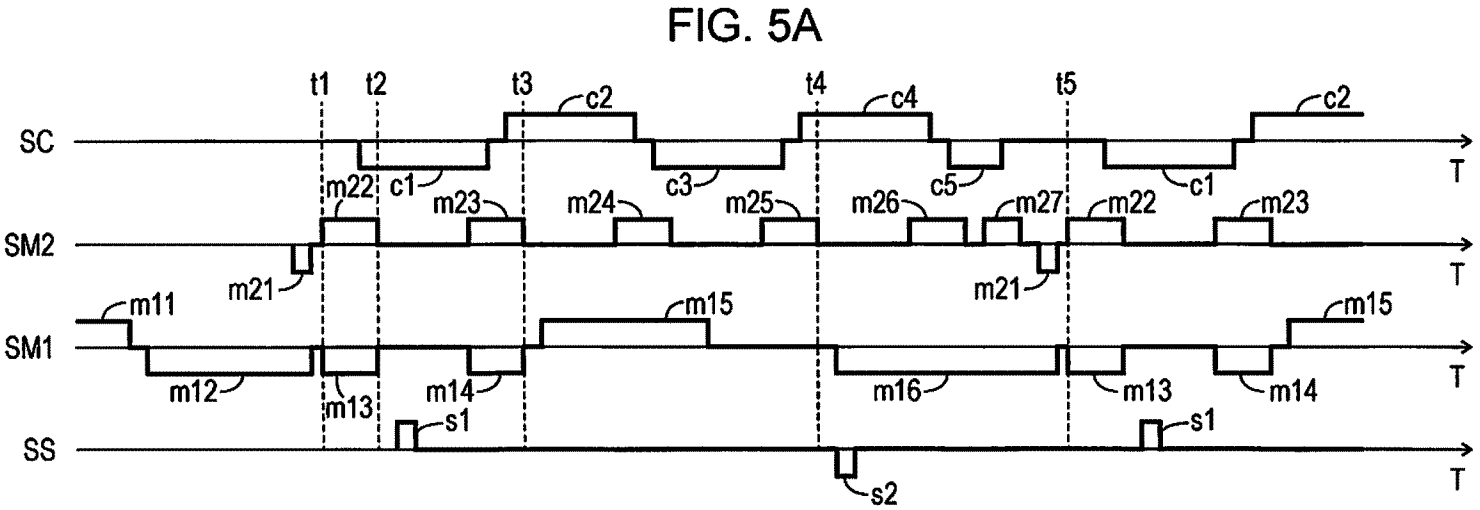
FIG. 5A is a timing chart of the present embodiment.

With reference to FIGS. 2A, 2B, 2C, 3A, 3B, and 5A, a method for transporting the medium P in the printing apparatus 10 will be described in detail. FIG. 5A is a timing chart for describing the movement of the carriage 16*b*, the first motor 17*a*, the second motor 17*b* and the driven roller 23*a* of the present embodiment by using a temporal axis T.

A signal SC is a signal provided by the control unit 11 to a carriage motor (not shown in the figure) that drives the carriage 16*b*, a signal SM1 is a signal provided by the control unit 11 to drive the first motor 17*a*, a signal SM2 is a signal provided by the control unit 11 to drive the second motor 17*b*, and a signal SS is a signal provided by the control unit 11 to drive the solenoid 50. The signals SC, SM1, SM2, and SS are shown simplified to a certain extent.

Signal waveforms c1, c2, c3, c4, and c5 that constitute the signal SC each represent a period during which the carriage 16*b* moves. Since the print head 16*a* performs ink ejection while the carriage 16*b* moves, the signal waveforms c1, c2, c3, c4, and c5 are considered to almost represent the timings of printing, that is, the timing of the pass of the print head 16*a*. The directions (positive and negative) of the signal waveforms c1, c2, c3, c4, and c5 which are alternately different represent that the directions of the carriage 16*b* are different. That is, the control unit 11 provides the signal SC shown in the figure to thereby cause the carriage 16*b* to move from one end to the other end of the main scan direction and the movement from the other end to one end of the main scan direction in an alternating manner.

Signal waveforms m11, m12, m13, m14, m15, and m16 that constitute the signal SM1 each represent a period during which the carriage 17*a* rotates. Difference in direction of the signal waveforms m11, m12, m13, m14, m15, and m16 represents the difference in rotation direction of the first motor 17*a*, that is, the difference between a forward rotation and a reverse rotation (which is the difference between the first drive mode and the second drive mode).

Similarly, signal waveforms m21, m22, m23, m24, m25, m26 and m27 that constitute the signal SM2 each represent a period during which the second motor 17*b* rotates. Difference in direction of the signal waveforms m21, m22, m23, m24, m25, m26, and m27 represents the difference in rotation direction (forward rotation and reverse rotation) of the second motor 17*b*. When the second motor 17*b* rotates in the forward direction, the rollers 24 and 25 rotates in the direction by which the medium P is transported downstream. Further, when the second motor 17*b* rotates in the reverse direction, the rollers 24 and 25 rotates in the direction by which the medium P is transported upstream. Further, signal waveforms s1 and s2 that constitute the signal SS represent the timing when the movable core 51 is displaced, that is, the timing when the driven roller 23*a* is displaced. Difference in direction of the signal waveforms s1 and s2 corresponds to the difference in direction of the electric current supplied to the solenoid 50.

1 Start of Medium Transportation in First Drive Mode

The control unit 11 starts transportation of the medium P from the cassette 31, for example, to start a printing process when the print job data is inputted from the external device 100. In this case, the control unit 11 provides the signal waveform m11 as the signal SM1 to the first motor 17*a*. The signal waveform m11 allows the first motor 17*a* to rotate in the forward rotation direction, enabling the first drive mode. In other words, all the rollers 20, 21, 22, and 23 rotate so as to supply the medium P from the cassette 31 to the transportation path 40. The state A in FIG. 2A shows that the medium P (medium P1) is transported from the cassette 31 in response to the driving of the first motor 17*a* based on the signal waveform m11. Further, a default position of the driven roller 23*a* is the first position. Accordingly, when transportation of the first medium P from the cassette 31 is started, the driven roller 23*a* is located at the first position.

2 Switching to Second Drive Mode

Then, the control unit 11 provides the signal wave form m12 as the signal SM1 to the first motor 17*a*. The signal wave form m12 allows the first motor 17*a* to rotate in the reverse rotation direction, enabling the first drive mode. In other words, the first drive mode is switched to the second drive mode, by which a power supply to the rollers 20 and 21 is stopped while the intermediate rollers 22 and 23 are continuously rotated. As a result, the medium P (medium P1) is continuously transported downstream. Although the first drive mode is a mode required to supply the medium P from the cassette 31 to the transportation path 40, it may cause the medium transportation to be disrupted due to difference in the load applied to the rollers. Specifically, there may be a case in which a force with which the medium P is nipped between the separation roller 21 and the driven roller 21*a* exceeds a force with which the medium P is nipped between the intermediate roller 22, the intermediate roller 23 and the driven rollers 22*a*, 22*b*, and 23*a*. In this case, slippage may occur between the intermediate rollers 22, 23 and the medium P. Therefore, the control unit 11 switches the first drive mode to the second drive mode to thereby stabilize the transportation of the medium P.

The control unit 11 switches the first drive mode to the second drive mode at the timing before the leading edge E1 of the medium P1 passes by the driven roller 23*a*. Specifically, as shown in the state A in FIG. 2A, the control unit 11 provides the signal waveform m12 to the first motor 17*a* to thereby switch the first drive mode to the second drive mode at the timing when the leading edge E1 of the medium P1 passes by the driven roller 22*b*, which is located most downstream among the driven rollers 21*a*, 22*a*, 22*b*, and 23*a* except for the driven roller 23*a*, which is the specific second roller, and does not pass by the driven roller 23*a*.

The control unit 11 calculates a shift amount of the medium P which has been transported from the cassette 31 on the basis of, for example, a pulse from a rotary encoder (not shown in the figure) that outputs a pulse corresponding to the rotation of the first motor 17*a*, to thereby recognize the current position of the leading edge E1 or the trailing edge E2 of the medium P. The size of the medium P is determined in advance. Alternatively, the control unit 11 may also recognize the current position of the medium P on the basis of the detection signal from a predetermined sensor disposed in the transportation path 40. Further, the positions of the rollers in the transportation path 40 are also determined in advance. With this recognition method of the position of the medium P, the control unit 11 can judge whether or not the leading edge E1 of the medium P1 is located between the driven roller 22*b* and the driven roller 23*a*.

3 Deskewing

As the medium P (medium P1) is transported downstream with the rotation of the intermediate rollers 22 and 23 by means of the first motor 17*a* driven in the second drive mode, the leading edge E1 then abuts against the print transportation roller 24 as shown in the state B in FIG. 2B. The control unit 11 performs deskewing of the medium P having the leading edge E1 abutting against the print transportation roller 24. When the leading edge E1 of the medium P passes by the medium detection sensor 26, the control unit 11 recognizes that the leading edge E1 of the medium P passes by the medium detection sensor 26 on the basis of the detection signal from the medium detection sensor 26. For example, at this timing, the control unit 11 provides the signal waveform m21 as the signal SM2 to the second motor 17*b*. The signal wave form m21 allows the second motor 17*b* to rotate in the reverse rotation direction. As a result, the rollers 24 and 25 start to rotate in the direction by which the medium P (medium P1) is returned upstream. On the other hand, since the above signal waveform m12 is continuously provided to the first motor 17*a*, the medium P (medium P1) is transported downstream with the rotation of the intermediate rollers 22 and 23. Under this situation, the medium P (medium P1) is subject to a force from the backward while the leading edge E1 is not allowed to advance downstream from the print transportation roller 24. As a result, an angle (skew) of the leading edge E1 to the transport direction Df is corrected. In other words, the medium P is deskewed.

4 Cueing

Subsequent to the deskewing, a first intermittent transportation is performed to the medium P (medium P1) which has been deskewed. The first intermittent transportation is also referred to as "cueing". The control unit 11 synchronizes the driving of the first motor 17*a* and the driving of the second motor 17*b* during the intermittent transportation by which a single medium P is transported by the intermediate rollers 22, 23 and the print transportation roller 24. In other words, at a timing t1 which is after the deskewing is completed (see FIG. 5A), the control unit 11 provides the signal waveform m13 to the first motor 17*a* and also provides the signal waveform m22 to the second motor 17*b* in a synchronizing manner. Accordingly, the rotation of the intermediate rollers 22 and 23 corresponding to the signal waveform m13 and the rotation of the print transportation roller 24 (and the output roller 25) corresponding to the signal waveform m22 are synchronized. As a result, transportation of the medium P (medium P1) by a predetermined distance, that is, cueing is performed. The timing when the cueing is completed is referred to as a timing t2 (see FIG.

5A). Due to start of cueing, the medium P (medium P1) becomes held by the print transportation roller 24 (and the driven roller 24*a*).

5 Separation of Specific Second Roller

After the cueing is completed, the control unit 11 energizes the solenoid 50 by the signal waveform s1 so as to shift the solenoid 50 from the protruded state to the housed state. As a result, the driven roller 23*a*, which is the specific second roller, is displaced from the first position to the second position. The state C in FIG. 2C shows that the driven roller 23*a* is displaced to the second position after the cueing of the medium P (medium P1) is completed. Thus, the control unit 11 causes the specific second roller to be displaced from the first position to the second position after the third roller (print transportation roller 24) holds the medium P.

Further, the control unit 11 provides the signal waveform c1 as the signal SC to the carriage motor at a predetermined timing before the cueing is completed to thereby start movement of the carriage 16*b*. The carriage 16*b* starts to move corresponding to the signal waveform c1. After the movement is started and the intermittent transportation is suspended, the pass of the print head 16*a* is performed, and then the movement is completed. The control unit 11 starts the next intermittent transportation at a predetermined timing before the movement of the carriage 16*b* corresponding to the signal waveform c1 is completed (the timing when the pass of the print head 16*a* during movement of the carriage 16*b* is completed). In other words, the control unit 11 provides the signal waveform m14 to the first motor 17*a* and also provides the signal waveform m23 to the second motor 17*b* in a synchronizing manner. Accordingly, the rotation of the intermediate rollers 22 and 23 corresponding to the signal waveform m14 and the rotation of the print transportation roller 24 (and output roller 25) corresponding to the signal waveform m23 are synchronized with each other. As a result, intermittent transportation of the medium P (medium P1) is performed. As described above, the intermittent transportation of the medium P (for example, see the signal waveforms m22, m23, m24, m25, and m26) and the movement of the carriage 16*b* (for example, see signal waveforms c1, c2, c3, c4, and c5) are alternately performed. Further, as shown in FIG. 5A, the control unit 11 controls the intermittent transportation of the medium P and the movement of the carriage 16*b* so that the respective execution timings are partially overlapped to each other, thereby reducing a period of time required for the printing process.

6 Start of Transportation of Subsequent Medium by Switching to First Drive Mode

After the driven roller 23*a* is displaced to the second position, the control unit 11 judges whether the trailing edge E2 of the currently printed medium P has passed by the most downstream roller among the second rollers except for the driven roller 23*a*, that is, the driven roller 22*b*. For example, at the timing t3 (see FIG. 5A) when the second intermittent transportation of the medium P (the second intermittent transportation including the cueing) is completed, the control unit 11 judges that the trailing edge E2 of the medium P has passed by the driven roller 22*b*. After the timing t3, the control unit 11 drives the first motor 17*a* in the first drive mode by providing the signal waveform m15 to the first motor 17*a*. As a result, both the PU roller 20 and the separation roller 21 again start rotation, and the next medium P is supplied from the cassette 31 to the transportation path 40.

In the state D shown in FIG. 3A, after the trailing edge E2 of the currently printed medium P1 has passed by the driven roller 22*b*, the next medium P (medium P2) is transported from the cassette 31 by the first motor 17*a* which is driven corresponding to the signal waveform m15. In the relationship between the medium P1 and the medium P2, the medium P1 and the medium P2 are referred to as a preceding medium and a subsequent medium, respectively. Of course, in the relationship between the medium P2 and the medium P transported from the cassette 31 subsequent to the medium P2, the medium P2 corresponds to the preceding medium and the medium P transported subsequent to the medium P2 corresponds to the subsequent medium.

As described above, in the intermittent transportation by which a single medium P is transmitted by both the intermediate rollers 22, 23 and the print transportation roller 24, the driving of the first motor 17*a* and the driving of the second motor 17*b* must be synchronized. Further, as is obvious from the above description, the first motor 17*a* performs intermittent transportation in the second drive mode. Accordingly, the control unit 11 must hold the second drive mode of the first motor 17*a* until the end of the period during which a single medium P is transported by both the intermediate rollers 22, 23 and the print transportation roller 24. During this period, the control unit 11 is not allowed to start transportation of the next medium P. The period during which a single medium P is transported by both the intermediate rollers 22, 23 and the print transportation roller 24 ends when the intermediate rollers 22 and 23 cannot keep on nipping the medium P, that is, when the trailing edge E2 of the medium P passes by the roller that can abut against the medium P and is located most downstream among the plurality of driven rollers 22*a*, 22*b*, and 23*a* that are disposed corresponding to the intermediate rollers 22 and 23.

The driven roller 23*a* which is located most downstream among the driven rollers 22*a*, 22*b*, and 23*a* is displaced from the first position to the second position after the above cueing. Accordingly, the period during which a single medium P is transported by both the intermediate rollers 22, 23 and the print transportation roller 24 ends when the trailing edge E2 of the medium P passes by the driven roller 22*b*. Therefore, the timing t3 at which the control unit 11 recognizes that the trailing edge E2 of the preceding medium passes by the driven roller 22*b* is the earliest timing at which the subsequent medium can be transported from the cassette 31 (the first motor 17*a* can be switched from the second drive mode to the first drive mode). On the basis of these viewpoints, the control unit 11 provides the signal waveform m15 to the first motor 17*a* immediately after the timing t3 so as to drive the first motor 17*a* in the first drive mode and start transportation of the subsequent medium.

After the trailing edge E2 of the medium P1 passes by the driven roller 22*b*, the medium P1 is transported solely by driving of the second motor 17*b*. According to the example shown in FIG. 5A, after the timing t3, the medium P1 is transported downstream by intermittent transportation performed by driving of the second motor 17*b* (rotation of the rollers 24 and 25) which corresponds to each of the signal waveforms m24, m25, and m26. Further, the medium P1 is printed as the movement of the carriage 16*b*, which corresponds to the signal waveforms c2, c3, c4, and c5, alternately performed with the intermittent transportation.

7 Switching to Second Drive Mode and Return of Specific Second Roller

After switching the first motor 17*a* to drive in the first drive mode as described above so as to transport the subsequent medium from the cassette 31, the control unit 11 again switches the first motor 17*a* to the second drive mode so as to stabilize the transportation as described above. In the present embodiment, the control unit 11 judges whether or not the trailing edge E2 of the currently printed medium P (preceding medium) has passed the position of the driven roller 23*a*. For example, at a timing t4 when the intermittent transportation of the medium P which corresponds to the signal waveform m25 shown in FIG. 5A is completed, the control unit 11 judges that the trailing edge E2 of the medium P has passed by the position of the driven roller 23*a*. After the timing t4, the control unit 11 drives the first motor 17*a* in the second drive mode by providing the signal waveform m16 to the first motor 17*a*. As a result, only the intermediate rollers 22 and 23 rotate among the rollers 20, 21, 22, and 23, which allow the subsequent medium to be continuously transported downstream.

Further, the control unit 11 causes the driven roller 23*a* to be displaced from the current second position to the first position when the trailing edge E2 of the currently printed medium P (preceding medium) has passed the position of the driven roller 23*a*. According to FIG. 5A, after the timing t4, the control unit 11 energizes the solenoid 50 by the signal waveform s2 so as to shift the solenoid 50 from the housed state to the protruded state. As a result, the driven roller 23*a*, which is the specific second roller, is displaced from the first position to the second position. The state E in FIG. 3B shows that the driven roller 23*a* is displaced to the first position after the trailing edge E2 of the medium P1, which is the preceding medium, has passed by the position of the driven roller 23*a*. Further, at the timing of the state E, the above first motor 17*a* has been switched to the second drive mode. As described above, when the first motor 17*a* is switched to drive in the second drive mode and the driven roller 23*a* is returned to the first position, the medium P2, which is the subsequent medium, can be transported in a stable manner while being nipped by the intermediate roller 23 and the driven roller 23*a*.

According to the example shown in FIG. 5A, the control unit 11 simultaneously generates the signal waveform m16 and the signal waveform s2. In other words, after the timing t4, the first motor 17*a* is switched to the second drive mode and the driven roller 23*a* is returned to the first position almost at the same time. However, these two operations are not necessarily performed at the same time. In particular, the driven roller 23*a* may be returned to the first position after the trailing edge E2 of the preceding medium passes by the position of the driven roller 23*a* and before the leading edge E1 of the subsequent medium reaches the position of the driven roller 23*a*. Accordingly, after the timing t4, the control unit 11 may cause the driven roller 23*a* to be returned to the first position after the first motor 17*a* is switched to the second drive mode. Specifically, the control unit 11 may return the driven roller 23*a* to the first position when the leading edge E2 of the subsequent medium reaches a position immediately preceding to the driven roller 23*a*.

As an example, a specific position between the position of the driven roller 22*b* and the position of the driven roller 23*a* in the transportation path 40 and close to the driven roller 23*a* (a position closer to the driven roller 23*a* than to the intermediate position between the position of the driven roller 22*b* and the position of the driven roller 23*a*) is referred to as the immediate preceding position. After timing t4, when judging that the leading edge E1 of the subsequent medium reaches the immediately preceding position, the control unit 11 generates the signal waveform s2 to cause the driven roller 23*a* to be displaced from the second position to the first position. In the state in which the driven roller 23*a* is located at the first position, a load is applied onto the intermediate roller 23 when the driven roller 23*a* presses the intermediate roller 23, which causes an increase in power consumption of the first motor 17*a*. In light of this problem, power consumption can be reduced by delaying a timing at which the driven roller 23*a* is returned from the second position to the first position as much as possible as described above (the driven roller 23*a* is returned to the first position when the leading edge E2 of the subsequent medium reaches the immediately preceding position).

8 Output and Next Deskewing

Assume that the movement of the carriage 16*b* corresponding to the signal waveform c5 in FIG. 5A is the movement of the last pass for a single medium P. The control unit 11 starts to provide the signal waveform m27 to the second motor 17*b* in coordination with the last part of the movement of the carriage 16*b* for the last pass to thereby cause the output roller 25 (and the print medium roller 24) to rotate so that the medium P (medium P1) is outputted from the output port 32 after printing is performed. On the other hand, as the medium P (medium P2) is transported downstream with the rotation of the intermediate rollers 22 and 23 by means of the first motor 17*a* driven in the second drive mode, the leading edge E1 abuts the print transportation roller 24. That is, the state E shown in FIG. 3B is followed by the state B shown in FIG. 2B. Of course, in interpretation of FIGS. 2A, 2B, 2C, 3A, and 38, when the medium P (medium P2) which corresponds to the subsequent medium in the state E is shifted to the state B, it corresponds to the medium P (medium P1) which is a target of deskewing.

After the output of the medium P, the process subsequent to the above "(3) Deskewing" is repeated. In other words, after providing the signal waveform m27 to the second motor 17*b*, the control unit 11 provides the signal waveform m21 to the second motor 17*b*. On the other hand, since the above signal waveform m16 is continuously provided to the first motor 17*a*, deskewing can be performed to the next medium P. FIG. 5A shows the timing at which the deskewing performed for the subsequent medium P after the output of the medium P is completed (the timing at which cueing of the subsequent medium P is started) is shown as a timing t5. After the timing t5, the processes in the timings t1 to t5 which are previously described are repeated. In the example shown in FIG. 5A, in the signal SC, the signal waveform c1 having the same direction as that of the signal waveform c5 is generated subsequent to the signal waveform c5. However, the control unit 11 may allow for movement of the carriage 16*b* (the movement which does not involve ink ejection by the print head 16*a*) by providing a signal waveform, which is not shown in the figure, to the carriage motor between the signal waveform c5 and the signal waveform c1. The time required for the timings t1 to t5 is a period from when the cueing of the medium P is started until when the cueing of the next medium P is started. Accordingly, this can be defined as a print time per a medium.

Effects of the present embodiment will be described. In order to accurately perform deskewing of the medium P having the leading edge E1 abutting against the print transportation roller 24, a force that press the medium P from the upstream is necessary. Accordingly, it is required to nip the medium P between the intermediate roller 23 and the driven roller 23*a* at a position on the upstream and in close vicinity to the print transportation roller 24 to transport the medium P downstream. On the other hand, in the state where the medium P after deskewing is nipped between the print transportation roller 24 and the driven roller 24*a*, the medium P can be straightly transported in the transport direction Df by rotation of the print transportation roller 24.

At this stage, if the medium P is tightly nipped at an upstream position relative to the print transportation roller 24, the medium P may have unnecessary skew or deflection. Therefore, as described above, the control unit 11 causes the driven roller 23*a* to be displaced from the first position to the second position after the print transportation roller 24 holds the medium P (from the state B shown in FIG. 2B to the state C shown in FIG. 2C). With this configuration, the medium P intermittently transported while being nipped between the print transportation roller 24 and the driven roller 24*a* is released from the force applied by the driven roller 23*a*, which allows the position of the medium P to be generally more stabilized. As a result, print quality is improved.

Moreover, the present embodiment contributes to improvement in print efficiency.

Figure 5B:
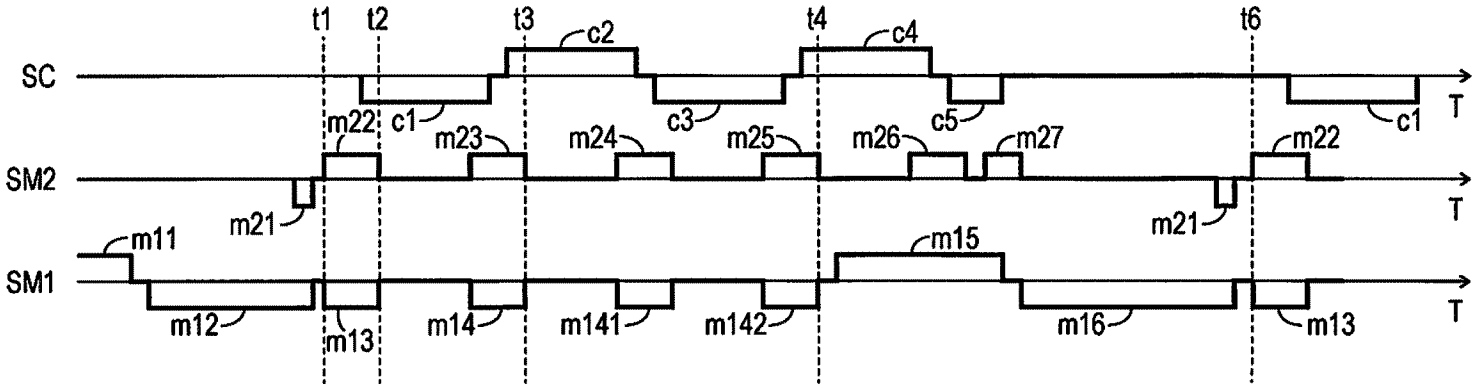
FIG. 5B is a timing chart of a comparative example.

FIG. 5B is a comparative example of the present embodiment (FIG. 5A), which is a timing chart for describing the movement of the carriage 16*b*, the first motor 17*a*, and the second motor 17*b* by using a temporal axis T in the same manner as FIG. 5A. In FIG. 5B, the same reference characters as those of FIG. 5A may be essentially the same as those of FIG. 5A. While one of the features of the present embodiment is a configuration in which the driven roller 23*a* which corresponds to the specific second roller is displaced between the first position and the second position, the comparative example does not have this configuration. In other words, the driven roller 23*a* in the comparative example maintains a position that can abut against the medium P as with the driven rollers 22*a* and 22*b* which face the intermediate rollers 22 and 23. Accordingly, FIG. 5B does not have indication regarding the signal SS.

As described above, in the intermittent transportation by which a single medium P is transmitted by both the intermediate rollers 22, 23 and the print transportation roller 24, the driving of the first motor 17*a* and the driving of the second motor 17*b* must be synchronized. In the comparative example, the period during which a single medium P is transported by both the intermediate rollers 22, 23 and the print transportation roller 24 ends when the trailing edge E2 of the medium P passes by the driven roller 23*a*. In other words, according to the comparative example, the timing t4 at which the control unit 11 recognizes that the trailing edge E2 of the preceding medium passes by the driven roller 23*a* is the earliest timing at which the subsequent medium can be transported from the cassette 31 (the first motor 17*a* can be switched from the second drive mode to the first drive mode). Accordingly, in the comparative example shown in FIG. 5B, the control unit 11 provides the signal waveform m15 to the first motor 17*a* after the timing t4 so as to drive the first motor 17*a* in the first drive mode and start transportation of the subsequent medium. In addition, signal waveforms m141 and m142 included in the signal SM1 shown in FIG. 5B are signal waveforms provided to the first motor 17*a* in synchronization with the signal waveforms m24 and m25 included in the signal SM2 for the intermittent transportation of the medium P.

In such a comparative example, considering the transportation after being switched to the second drive mode (transportation corresponding to the signal waveform m16) after the transportation of the subsequent medium is started in the first drive mode at the timing t4, it obviously takes a longer period of time until the leading edge E1 of the subsequent medium abuts against the print transportation roller 24 compared with the present embodiment (FIG. 5A). In FIG. 5B, the timing when deskewing performed to the subsequent medium P after the output of the medium P is completed (the timing at which cueing for the next medium P is started) is shown as a timing t6. In the comparative example, the period of time required for the timings t1 to t6 is a print time per medium. In other words, as is obvious from comparison between FIGS. 5A and 5B, the print time per medium according to the present embodiment (FIG. 5A) is significantly shorter than the print time per medium according to the comparative example (FIG. 5B). Therefore, the present embodiment can be considered to have significantly improved the print efficiency (the number of sheets that can be printed per unit time).

In other words, the present embodiment can be considered to have narrowed the inter-medium distance compared with the comparative example. The distance between the trailing edge E2 of the medium P1 shown in the state E of FIG. 3B and the leading edge E1 of the medium P2 is one example of the inter-medium distance enabled in the present embodiment. Assuming that the comparative example is applied to the state E shown in FIG. 3B, the transportation of the subsequent medium P2 from the cassette 31 still has not been started or has been just started immediately after the trailing edge E2 of the medium P1 passes by the driven roller 23*a*. As a consequence, the comparative example does not enable the inter-medium distance shown in the state E in FIG. 3B, and has a longer inter-medium distance. That is, the present embodiment narrows the inter-medium distance and thus improves the print efficiency.

In addition, one way to narrow the inter-medium distance could be reducing a path length from the PU roller 20 which is part of the transportation path 40 to the intermediate roller 23. If such a path length is shortened, the leading edge E1 of the subsequent medium can be brought closer to the trailing edge E2 of the preceding medium in a shorter period of time by driving of the first motor 17*a* even if the transportation of the subsequent medium is started after the trailing edge E2 of the preceding medium passes by the driven roller 23*a*, since the distance to the trailing edge E2 of the preceding medium is short. However, for reasons of design of the printing apparatus 10, part of the path from the PU roller 20 to the intermediate roller 23 often serves as part of the transportation path as well by which the medium is turned over for so-called double-sided printing. As a consequence, an increase in the path length leads to an inconvenience in that the length of the medium that can be turned over is limited. Further, providing a separate transportation path having a length required for turning over of the medium while decreasing the path length is not practical in light of the increase in the product cost and the like. From these points of view as well, the present embodiment provides a configuration which is considerably useful for narrowing the inter-medium distance.

The present embodiment can further adopt variations as described below.

The printing apparatus 10 can continuously perform printing to a plurality of media P on the basis of the print data included in the print job data. In such a situation, if printing by the print unit 16 to the medium P held by the print transportation roller 24, that is, the currently performed printing is the printing for the last page, the control unit 11 stops the first motor 17*a* when the trailing edge E2 of the medium P to which the printing for the last page is performed passes by the driven roller 22*b*. The control unit 11 can judge whether it is the last page or not by checking the presence or absence of a specific code that indicates the terminating end of the file (for example, EOF (End of File)) by each page of the print data.

In the present embodiment, the driven roller 23*a* is located in the second position when the trailing edge E2 of the medium P passes by the driven roller 22*b* (see the state D in FIG. 3A). Accordingly, after the trailing edge E2 of the medium P on which the last page is printed passes by the driven roller 22*b*, the first motor 17*a* does not need to be driven, and therefore, the first motor 17*a* is immediately stopped. In this configuration, the first motor 17*a* can be stopped at an earlier timing, leading to the reduction in power consumption. Further, when the printing apparatus 10 performs double-sided printing to the medium P, the control unit 11 may temporarily stop the first motor 17*a* when the trailing edge E2 of the medium P passes by the driven roller 22*b* in the transportation process for printing onto the front surface of the medium P (the surface which is initially printed). In this case, the control unit 11 resumes driving of the first motor 17*a*, which has been temporarily stopped, at the timing when the intermediate rollers 22 and 23 should be rotated in the process of transportation for printing onto the back surface of the medium P (the surface subsequently printed) after the printing onto the front surface is finished.

The supply source of the medium P is not limited to the cassette 31.

For example, the printing apparatus 10 may include a tray not shown in the figure above the rear surface 30R of the housing 30. A plurality of media are loaded on the tray, and the PU roller and the separation roller are disposed so that the medium can be supplied one by one as with the cassette 31. In FIG. 2A (state A), a transportation path 41 having the tray as a supply source is indicated as one example by the alternate long and two short dash line arrow. The transportation path 41 merges into the transportation path 40 at a position upstream relative to the driven roller 23*a* in the transportation path 40.

Moreover, the printing apparatus 10 may include a supply port not shown in the figure on the front surface 30F of the housing 30. A user can manually provide the medium one by one from the supply port into the printing apparatus 10. In FIG. 2A (state A), a transportation path 42 having the supply port as a supply source is indicated as one example by the alternate long and two short dash line arrow. Although the detail is not shown, the transportation path 42 merges into the transportation path 40 at a position upstream relative to the intermediate roller 22 in the transportation path 40. Of course, rollers and the like are provided in the transportation path 41 and the transportation path 42 in the housing 30 so as to transport the medium in the transportation path 41 and the transportation path 42.

The medium transported along the transportation path 41 and the medium transported along the transportation path 42 are both pass by the position of the driven roller 23*a* after being merged into the transportation path 40. Accordingly, part or all of the transportation method according to the present embodiment can be also applied to the medium transported along the transportation path 41 and the medium transported along the transportation path 42 as with the medium P transported from the cassette 31.

What is claimed is:

1. A printing apparatus comprising:

a print unit that performs printing onto a medium;

a first roller that transports the medium along a predetermined transportation path;

a plurality of second rollers cooperating with the first roller to nip the medium therebetween at a plurality of positions that face the first rollers;

a third roller disposed downstream relative to the first roller and the second roller in the transportation path so as to hold the medium which has been transported by the first roller and transport the medium to a print path in which printing is performed by the print unit;

a specific second roller which is a roller located most downstream in the transportation path among the plurality of the second rollers, the specific second roller being displaced between a first position in which the specific second roller cooperates with the first roller to nip the medium therebetween and a second position in which the specific second roller is separated from the first roller and does not hold the medium; and a control unit that controls each of the roller and the print unit, wherein the control unit causes the specific second roller to be displaced from the first position to the second position after the medium is held by the third roller.

2. The printing apparatus according to claim 1, further comprising:

a first drive source that rotates the first roller; and a second drive source that rotates the third roller, wherein the first roller includes a supply roller that supplies the medium from the supply source of the medium to the transportation path, and a transportation roller that transports the medium supplied by the supply roller to a downstream region in the transportation path, and the control unit causes the supply roller to be rotated by the first drive source to thereby supply a subsequent medium from the supply source to the transportation path when a trailing edge of the medium passes by the roller which is located most downstream in the transportation path among the second rollers except for the specific second roller after the specific second roller is displaced to the second position.

3. The printing apparatus according to claim 2, wherein, when the trailing edge of the medium passes by a position of the specific second roller, the control unit allows only the transportation roller to be rotated by the first drive source and causes the specific second roller to be displaced from the second position to the first position.

4. The printing apparatus according to claim 3, wherein the control unit causes the specific second roller to be displaced from the second position to the first position when the leading edge of the subsequent medium reaches a specific position which is a position between the specific second roller and the roller which is located most downstream in the transportation path among the second rollers except for the specific second roller, and the position being close to the specific second roller, after the trailing edge of the medium passes by the position of the specific second roller.

5. The printing apparatus according to claim 2, wherein, if printing by the print unit to the medium held by the third roller is printing for the last page, the control unit stops the first drive source when the trailing edge of the medium to which the printing for the last page is performed passes by the roller which is located most downstream in the transportation path among the second rollers except for the specific second roller.

* * * * *